US008043546B2

(12) United States Patent
Horsham

(10) Patent No.: US 8,043,546 B2
(45) Date of Patent: Oct. 25, 2011

(54) MESH AND METHODS AND APPARATUS FOR FORMING AND USING MESH

(75) Inventor: Kayne Bruce Horsham, Wellington (NZ)

(73) Assignee: Kaynemaile Limited, Wellington (NZ)

( * ) Notice: Subject to any disclaimer, the term of this patent is extended or adjusted under 35 U.S.C. 154(b) by 1291 days.

(21) Appl. No.: 11/508,329

(22) Filed: Aug. 23, 2006

(65) Prior Publication Data

US 2007/0042210 A1 Feb. 22, 2007

Related U.S. Application Data

(63) Continuation of application No. PCT/NZ2004/000104, filed on May 27, 2004, and a continuation-in-part of application No. PCT/NZ2004/000033, filed on Feb. 23, 2004.

(30) Foreign Application Priority Data

Mar. 12, 2003 (NZ) ..... 523971

(51) Int. Cl.
*B28B 3/00* (2006.01)

(52) U.S. Cl. ..... 264/297.8; 264/242; 264/297.9; 428/53; 249/57

(58) Field of Classification Search ..... 264/297.8, 264/242, 297.9; 428/53; 249/57
See application file for complete search history.

(56) References Cited

U.S. PATENT DOCUMENTS

| | | | | |
|---|---|---|---|---|
| 948,615 A | | 2/1910 | Pratt | |
| 1,028,904 A | | 6/1912 | Pratt | |
| 1,666,951 A | * | 4/1928 | Soderstrom | 140/3 B |
| 2,051,653 A | | 8/1936 | Rich | |
| 2,640,789 A | * | 6/1953 | Hausner | 427/247 |
| 2,752,636 A | | 7/1956 | Morin | |
| 3,284,260 A | * | 11/1966 | Best | 156/212 |
| 3,284,806 A | | 11/1966 | Prasser | |
| 3,333,299 A | | 8/1967 | Florjancic | |
| 3,690,369 A | * | 9/1972 | Wheeler | 164/351 |
| 3,892,268 A | | 7/1975 | Asbeck | |
| 4,279,122 A | | 7/1981 | Rogers | |
| 4,356,569 A | | 11/1982 | Sullivan | |
| 4,471,495 A | | 9/1984 | Kruse et al. | |
| 4,564,539 A | | 1/1986 | Tsuji | |
| 4,599,751 A | | 7/1986 | Bouwhuis | |

(Continued)

FOREIGN PATENT DOCUMENTS

DE 25 24 553 7/1976

(Continued)

OTHER PUBLICATIONS

International Search Report of PCT/NZ2004/000104, mailed Sep. 2, 2004.

(Continued)

*Primary Examiner* — Richard Crispino
*Assistant Examiner* — Elizabeth Royston
(74) *Attorney, Agent, or Firm* — Nixon & Vanderhye P.C.

(57) ABSTRACT

A method of forming a mesh by a moulding a link element around other link elements to form a mesh in which the interlinking link elements are formed as continuous unjoined loops by a moulding process. An apparatus for forming a mesh including a plurality of first cavities for accommodating first link elements and a plurality of second cavities for forming interlinking link elements. The method and apparatus allow the continuous production of mesh formed of a range of materials including plastics materials.

35 Claims, 20 Drawing Sheets

U.S. PATENT DOCUMENTS

| | | | | | |
|---|---|---|---|---|---|
| 4,802,242 | A | * | 2/1989 | Lars-Jos | 2/2.5 |
| 5,511,241 | A | | 4/1996 | Ziegler | |
| 5,771,448 | A | | 6/1998 | Honkala | |
| 5,771,488 | A | | 6/1998 | Honkala | |
| 5,808,852 | A | | 9/1998 | Iannotti | |

FOREIGN PATENT DOCUMENTS

| | | | |
|---|---|---|---|
| DE | 2524553 | A | 7/1976 |
| EP | 0 469 976 | | 2/1992 |
| EP | 469976 | B | 2/1992 |
| EP | 0 679 457 | | 11/1995 |
| EP | 679457 | B | 11/1995 |
| GB | 1 507 372 | | 4/1978 |
| RU | 2 051 000 | C1 | 12/1995 |
| WO | 95/07033 | A | 3/1995 |
| WO | WO 95/07033 | | 3/1995 |
| WO | WO 02/21952 | A1 | 3/2002 |
| WO | WO 2004/080687 | | 9/2004 |

OTHER PUBLICATIONS

International Search Report of PCT/NZ2004/000033, mailed Apr. 8, 2004.

West Pac Industrial, The Zip Tie People, Retrieved from the Internet Mar. 29, 2004, Document Archived May 6, 2001, URL: http://web.archive.org/web/20010506042653/http://www.socalmall.com/westpac/uses.htm.

Derwent Abstract Accession No. 96-400515/40, RU 2051000 C1, Dec. 27, 1995.

* cited by examiner

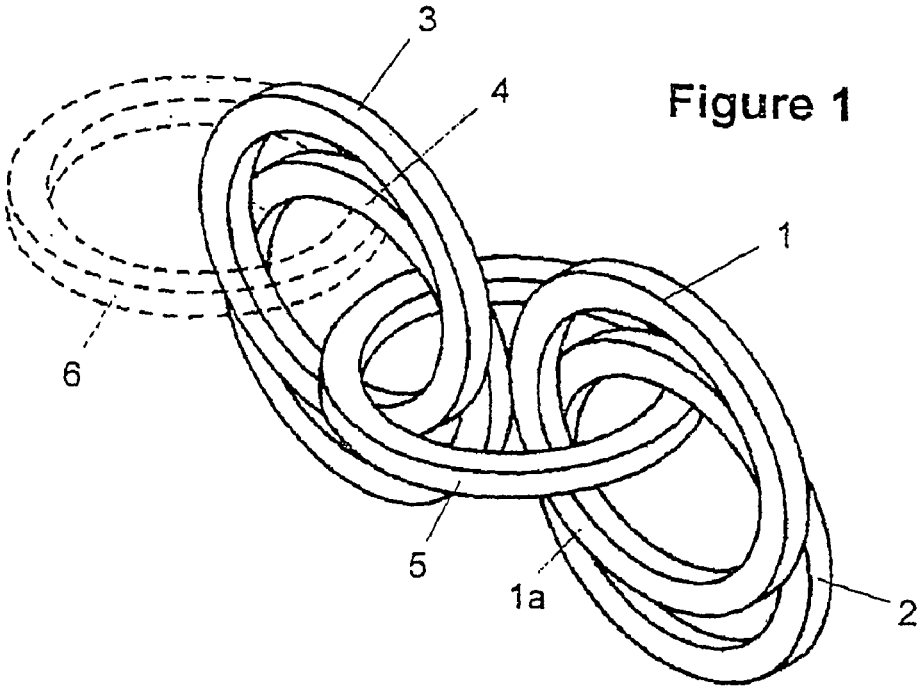
Figure 1
Figure 2
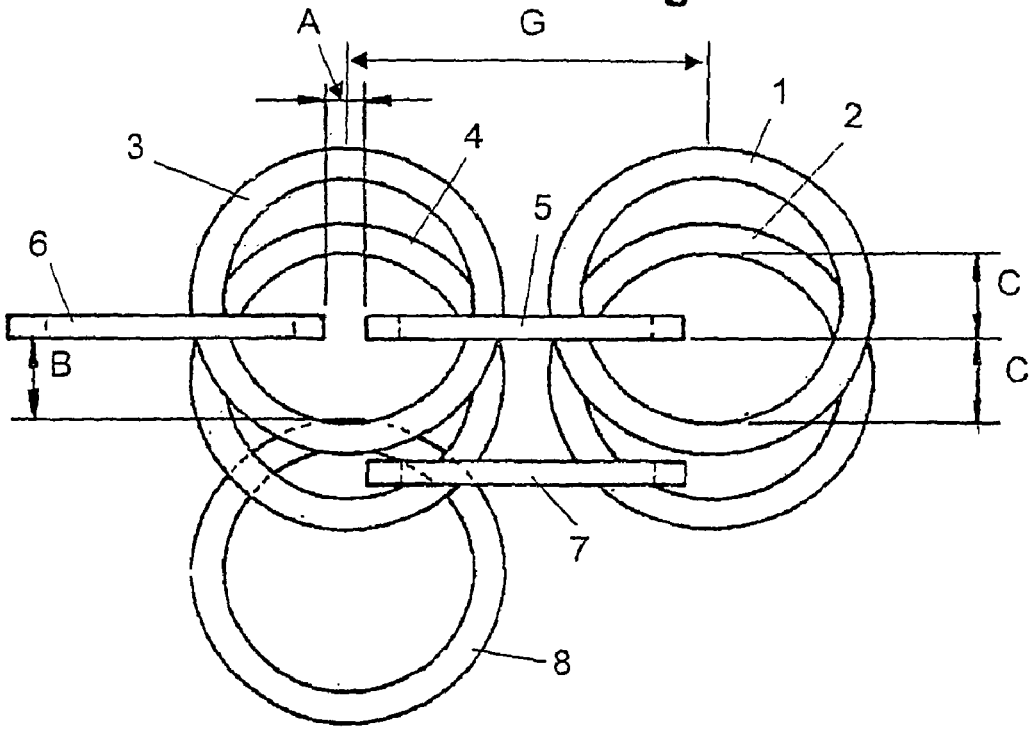

B - B X section

A - A X section

MESH AND METHODS AND APPARATUS FOR FORMING AND USING MESH

CROSS REFERENCE TO PRIORITY APPLICATIONS

This application is a Continuation of PCT/NZ2004/000104, filed 27 May 2004, and is a Continuation-In-Part of PCT/NZ2004/000033, filed 23 Feb. 2004 and claiming the benefit of NZ Application No. 523971, filed 12 Mar. 2003, each incorporated herein by reference in its entirety.

FIELD OF THE INVENTION

The present invention relates to methods and apparatus for forming mesh utilising moulded interlinking link elements. The invention also relates to mesh formed by the method of the invention, products incorporating the mesh and methods of using the mesh. Where the term "mesh" is used in this specification it means a mesh formed of interlinking link elements, such as rings.

BACKGROUND

Mesh formed of interlinking link elements is best known in the form of chain mail. Chain mail has traditionally been formed by interconnecting closed metal rings with open metal rings and then closing the open rings by a process such as mechanical deformation, welding etc. In another method split rings formed of spring steel or some other resilient material are used as the interlinking link members and are temporarily opened using a tool, such as pliers, to enable interconnection to other link members. In recent times mesh has been formed from plastics material by joining closed rings with open rings and then mechanically fastening, welding or gluing the open rings closed.

It has been time-consuming, labourious and expensive to manufacture chain mail/mesh using traditional methods. Chain mail/mesh including unclosed link elements can only be exposed to limited forces before link elements fail. Where the interlinking link elements are closed the joint may detract from the appearance of the finished mesh. Such methods have also limited the materials that may be utilised in the manufacturing of mesh and have limited the practical size of link elements.

Whilst there have been complex apparatus for forming mesh by folding sections of wire, to date there has been no automated process for the continuous and economic production of chain mail/mesh for mass-market applications.

SUMMARY OF THE INVENTION

It is an object of the present invention to provide an automated process and apparatus for the continuous production of mesh.

It is a further object of the present invention to provide mesh having strong structural integrity and an attractive appearance.

It is a further object of the present invention to provide a mesh that is economic to produce for a range of applications.

It is a further object of the invention to provide novel mesh products and methods of using mesh.

Each of the above objects is to be read disjunctively with the object of at least providing the public with a useful choice.

According to first aspect of the invention there is provided a method of forming a mesh comprising:

a. providing a plurality of link elements; and b. moulding a plurality of link elements through the link elements so as to interconnect the link elements to form a continuous mesh of interconnected link elements.

According to a further aspect of the invention there is provided a method comprising:

a. positioning a first plurality of link elements in a first plurality of first positions in a mould;
b. positioning a second plurality of link elements in a second plurality of second positions in the mould;
c. moulding a third plurality of link elements in a third plurality of positions in the mould to interlink with the first plurality and the second plurality of link elements;
d. advancing a subset of the first plurality of link elements to reside in the second plurality of second positions in the mould; and
e. moulding a fourth plurality of link elements to interlink with the subset of the first plurality of link elements.

There is also provided a mesh formed by the method of the invention.

According to another aspect of the invention there is provided an apparatus for forming a mesh including a mould formed as a plurality of sections, at least some of which close together to define cavities to mould link elements and separate to release moulded link elements, the mould including:

a. a plurality of first cavities to retain a plurality of link elements at spaced intervals; and
b. a plurality of second cavities dimensioned and arranged when the mould sections are closed to form cavities to form link elements in the second cavities that pass through link elements located within the first cavities.

According to a further aspect of the invention there is provided a mesh formed of link elements wherein interlinking link elements are formed as continuous unjoined loops by a moulding process.

According to another aspect of the invention there is provided an apparatus comprising:

a plurality of link elements without joins interlinked to form a two-dimensional mesh of the link elements.

BRIEF DESCRIPTION OF THE DRAWINGS

The invention will now be described by way of example with reference to the accompanying drawings in which:

FIG. 1 is a perspective view illustrating the relative positions of rings in a method of producing a row of mesh;

FIG. 2 is a front view illustrating the relative positions of rings when a further row of rings is joined;

DETAILED DESCRIPTION OF ILLUSTRATED EMBODIMENTS

An embodiment of the present invention includes a method of forming mesh in which the link elements may be in the form of unjoined closed loops. However, the link elements may take many forms including forms having a single aperture therethrough, such as rings, forms having multiple apertures etc.

Referring to FIG. 1 a method for continuously producing mesh is described. Preformed rings 1 to 4 are arranged in a first orientation with pairs 1, 2 and 3, 4 arranged so that portions of their central apertures overlap. Further such pairs may be provided in a row at spaced intervals in the plane of rings 1 to 4 to form a length of mesh as required. A ring 5 may then be moulded so that it passes through the central apertures of rings 1 to 4 as shown. Ring 6 illustrates how further rings may simultaneously be formed along row.

Figure 3:
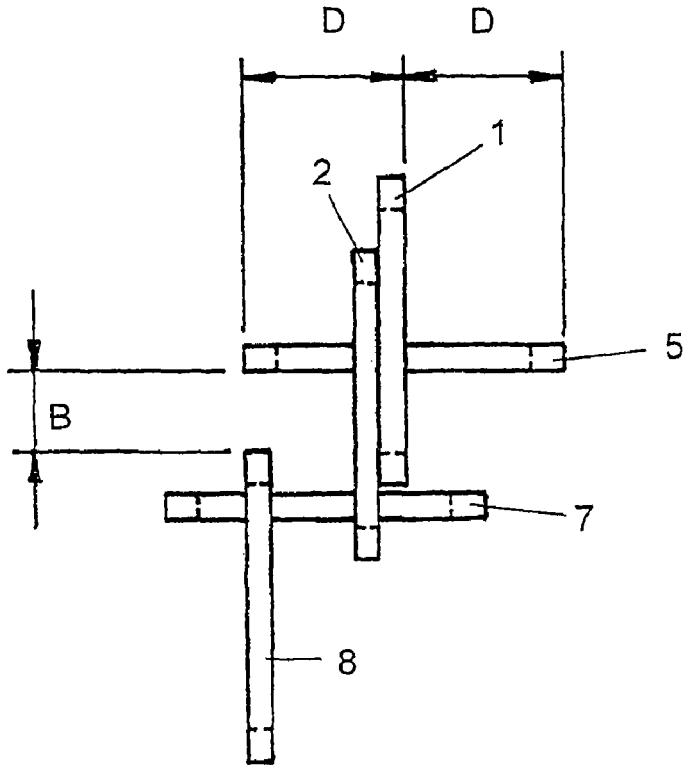
FIG. 3 is a side view of the rings shown in FIG. 2.

Referring now to FIGS. 2 and 3 the production of a subsequent row of mesh is described. Ring 3 in FIG. 1 assumes the position of ring 4 in FIG. 2 and ring 1 in FIG. 1 assumes the position of ring 2 in FIG. 2. Ring 5 in FIG. 1 assumes the position of ring 7 in FIG. 2. New rings 3 and 1 are introduced to the positions shown in FIG. 2. A new ring 5 is moulded through the central apertures of rings 1 to 4. In this way it will be seen that by sequentially introducing a new row of rings 1 and 3 and moulding a new ring 5 through new rings 1 and 3 and old rings 2 and 4 that a mesh may be continuously manufactured. It will be appreciated that this pattern may be extended in either direction to obtain the desired width of mesh.

Figure 4:
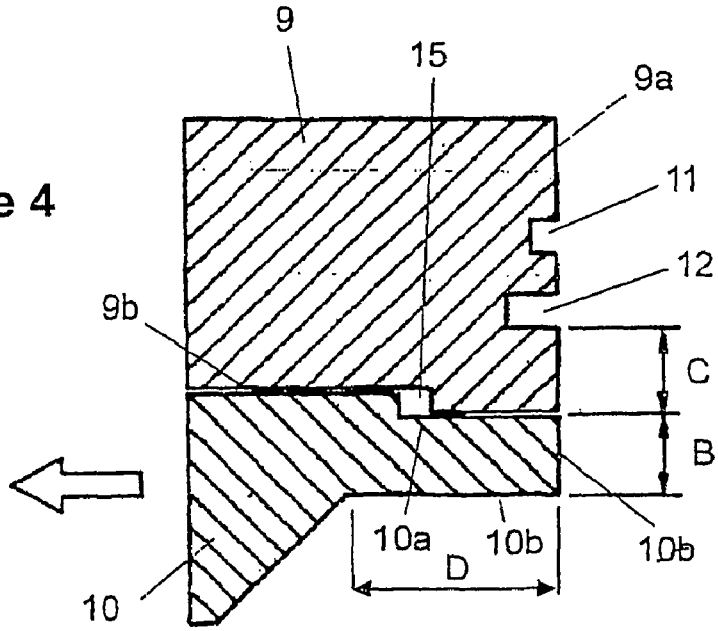
FIGS. 4 and 5 are sectional views of sections of a simple mould to illustrate the operations in a method of manufacturing mesh.
Figure 5:
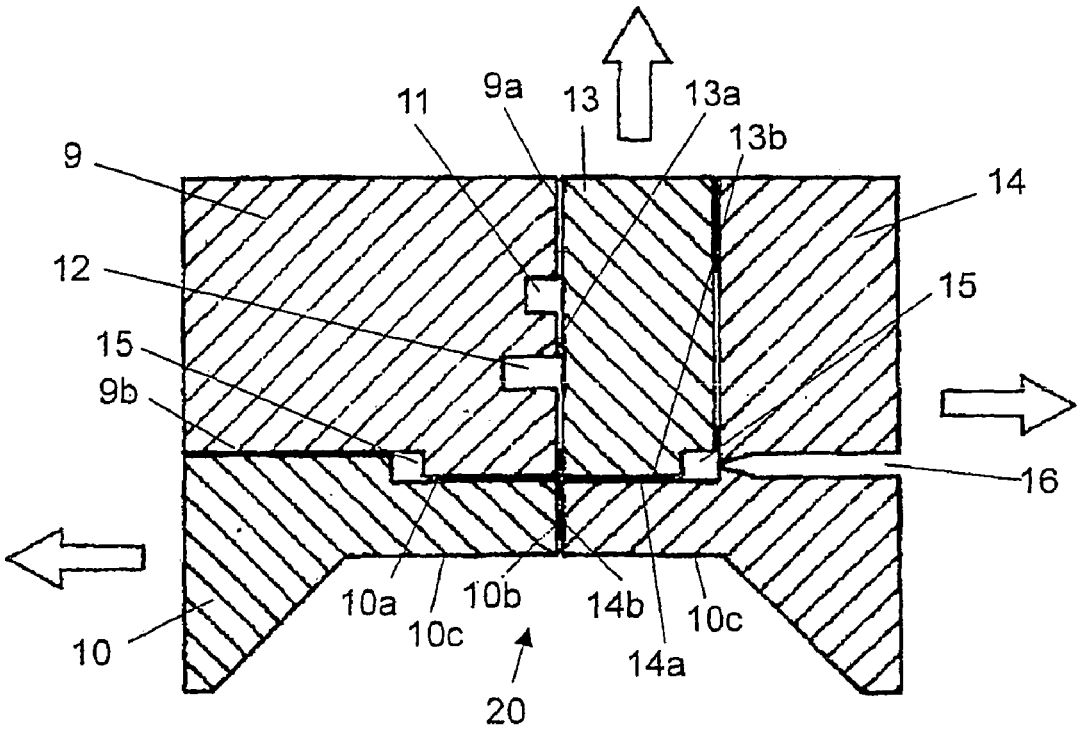

Referring now to FIGS. 4 and 5 a cross-sectional side view of a basic mould for forming a continuous mesh will be described in the context of the arrangement shown in FIG. 3. The mould consists of mould sections 9, 10 and 14 and finger 13. Mould sections 9 and 10 part at mould faces 9*b* and 10*a* and mould sections 9 and 10 part from finger 13 at faces 9*a*, 10*b* and 14*b*. Annular cavity 12 is dimensioned to retain ring 2 and annular cavity 11 is dimensioned to retain ring 1. The relative component spacings indicated by the letters B, C and D are indicated respectively in FIGS. 2 to 4.

A finger 13 of semicircular cross-section defines half of the central aperture of ring 5 to be formed in cavity 15. Plastics may be introduced into the mould, when closed as shown in FIG. 5, to form a ring 5 in cavity 15. Mould sections 9 and 10 may then be moved to the left to open the mould, finger 13 lifted upwards and mould sections 9 and 10 moved apart to free ring 5 moulded in cavity 15.

To form the next row the ring in cavity 11 is moved to cavity 12, a new ring is placed in cavity 11, the mould is closed as shown in FIG. 5 and a new ring is formed in cavity 15. It will be appreciated that FIG. 5 shows a section of a mould which may be repeated along the mould to form a continuous row of mesh.

Figure 6A:
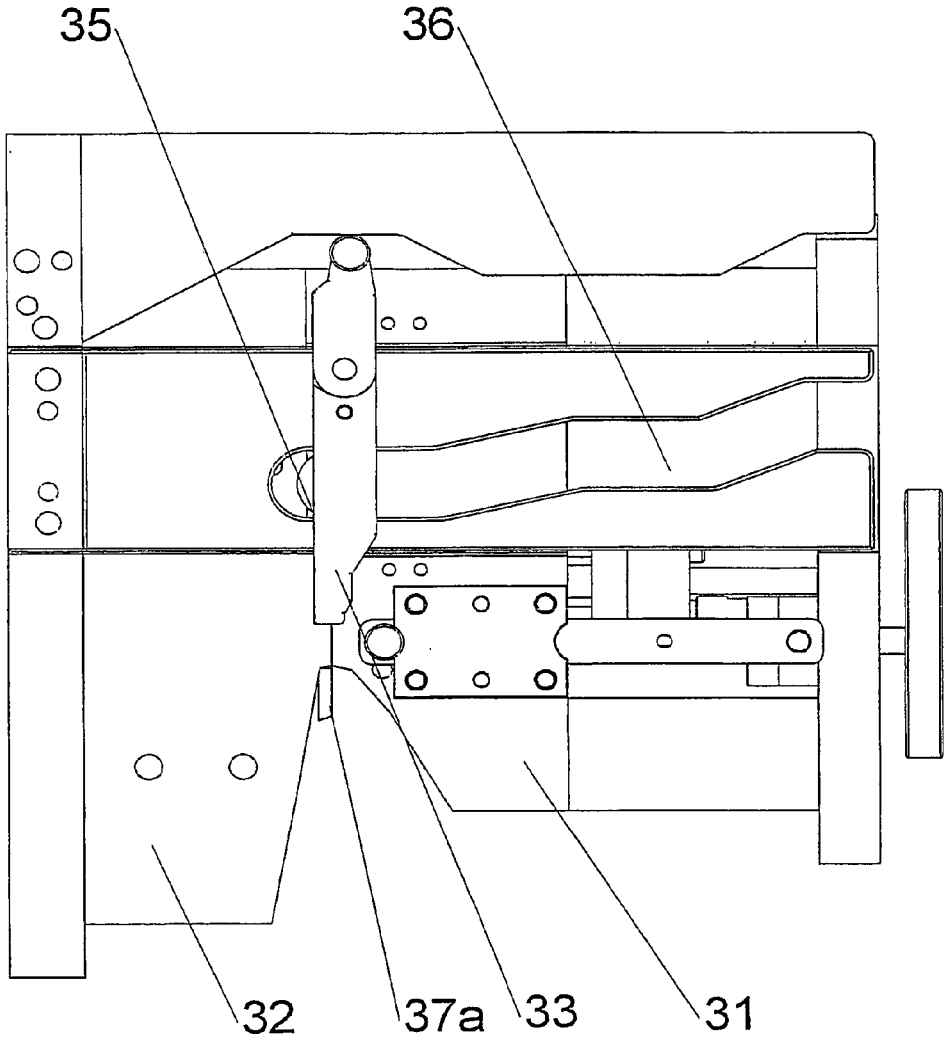
FIG. 6*a* is a side view of an apparatus suitable for continuously manufacturing mesh shown in a closed position.
Figure 6B:
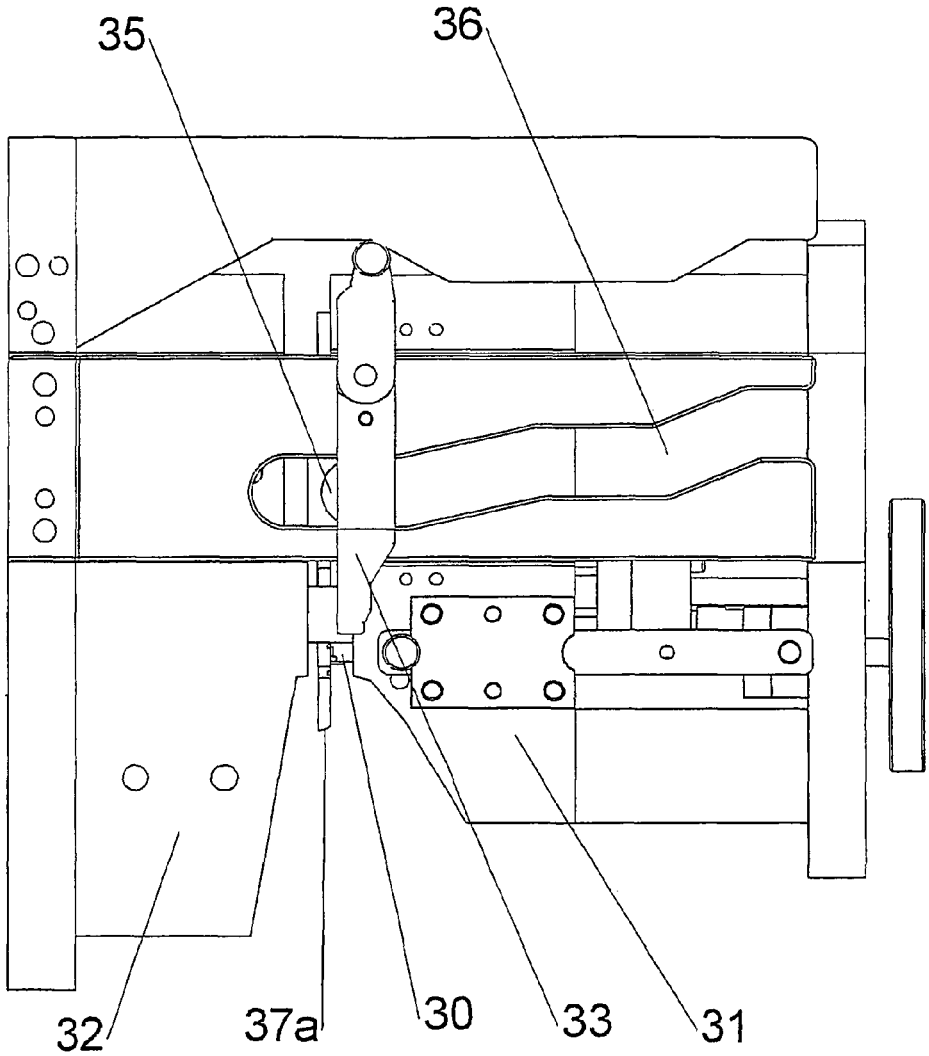
FIG. 6*b* is a side view of the apparatus shown in FIG. 6*a* in a partially open at configuration.
Figure 6C:
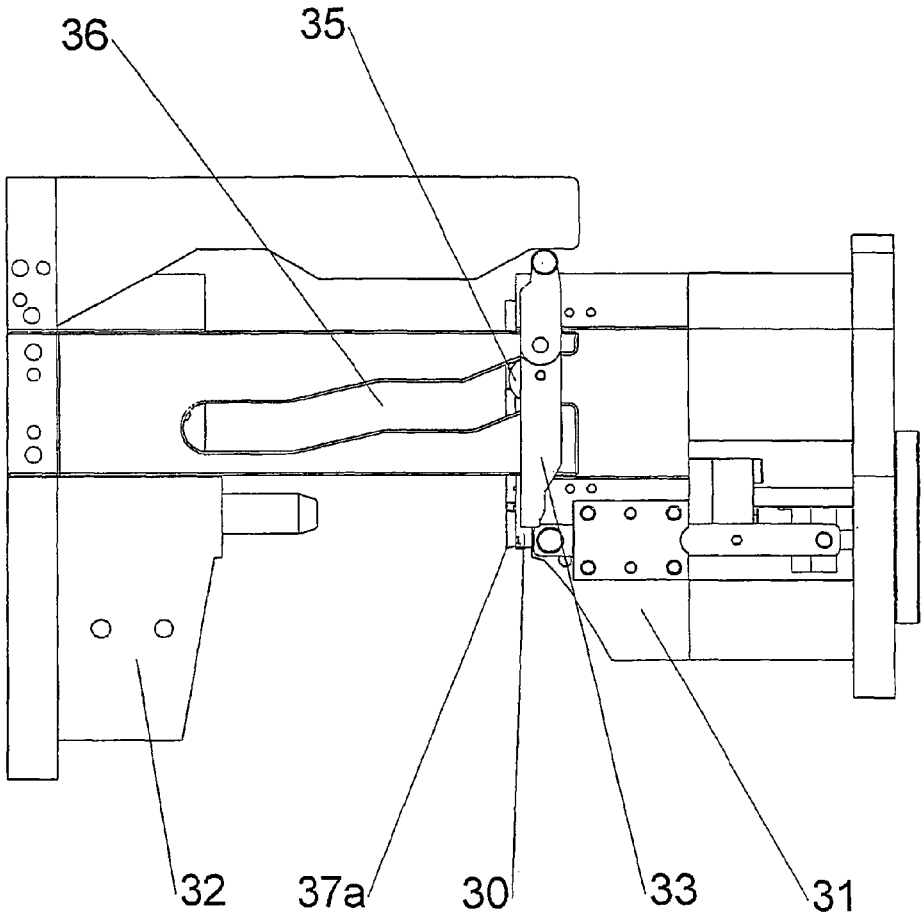
FIG. 6*c* is a side view of the apparatus shown in FIG. 6*a* in a fully open configuration.

Referring now to FIGS. 6*a* to 18 an apparatus for continuous mesh production is described. FIGS. 6*a* to 6*c* show the major components of the apparatus including mould sections 30, 31 and 32. Mould sections 30 and 31 can separate from mould section 32 as seen in FIGS. 6*b* and 6*c*. A plurality of fingers, one of which is indicated at 37*a* move with mould section 30 and are movable vertically with respect thereto. Mould section 30 is movable with respect to mould section 31 to allow moulded link elements to be released as shown in FIG. 6*b*. Arm 33 is connected to bar 34 (shown in FIG. 7 and subsequently) which raises and lowers the fingers 37a as roller 35 is guided in slot 36 and section 30 is moved away from section 32.

Figure 7:
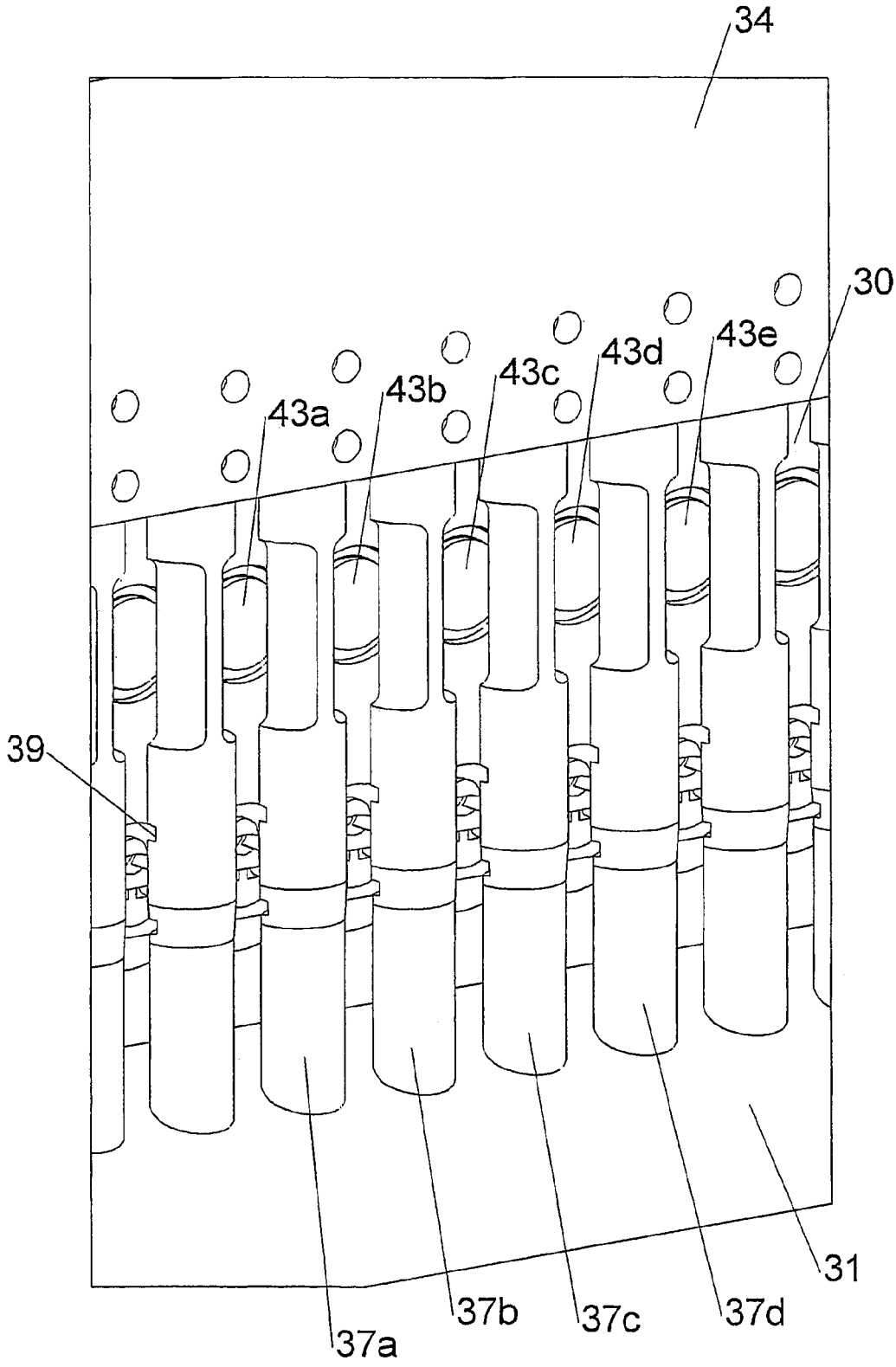
FIG. 7 is a perspective view showing a portion of the working faces of the two mould sections forming one half of the mould of the apparatus shown in FIG. 6 with an array of fingers in front of the working face.
Figure 8:
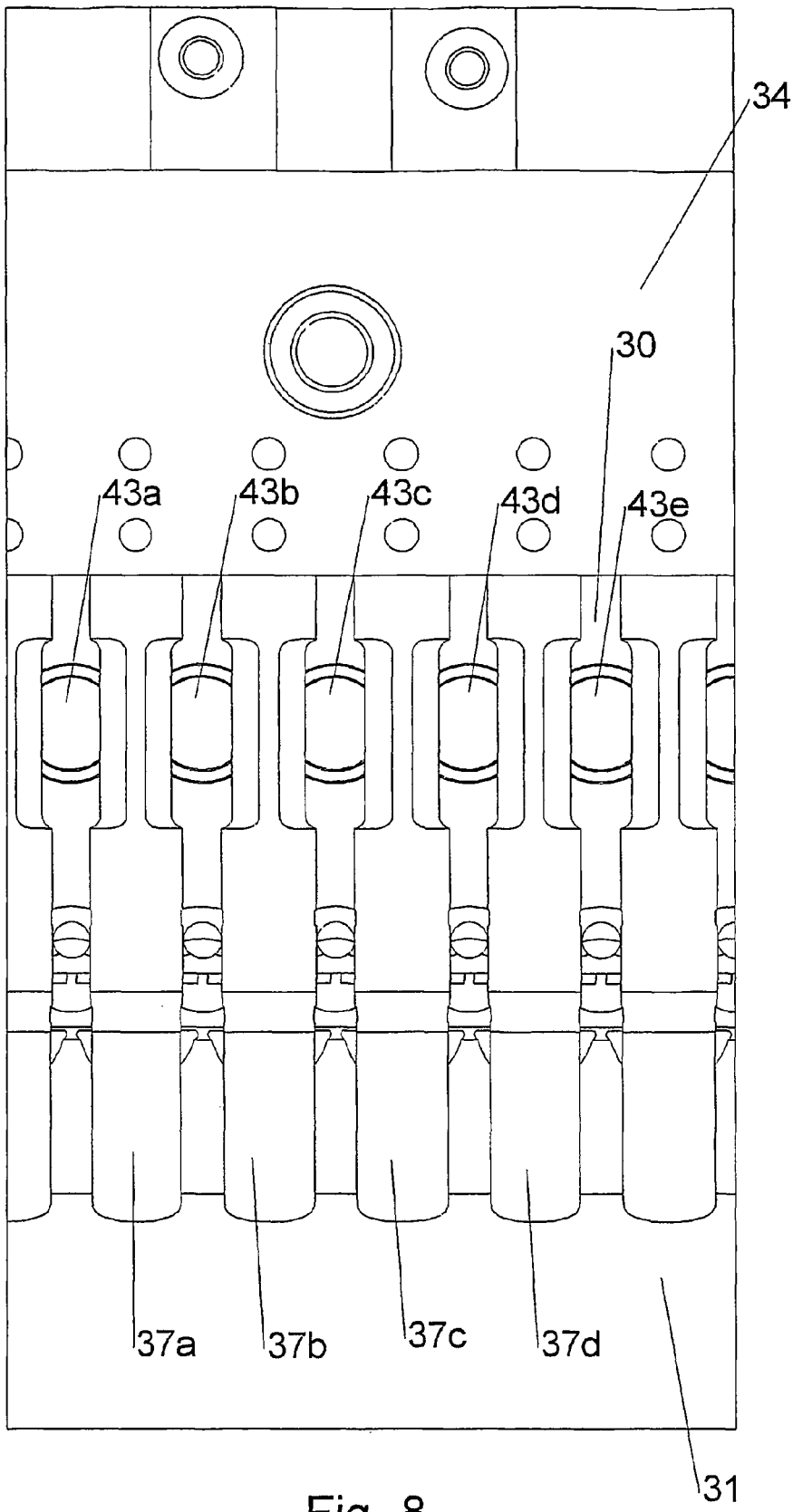
FIG. 8 shows a front view of a portion of the working face shown in FIG. 7.
Figure 9:
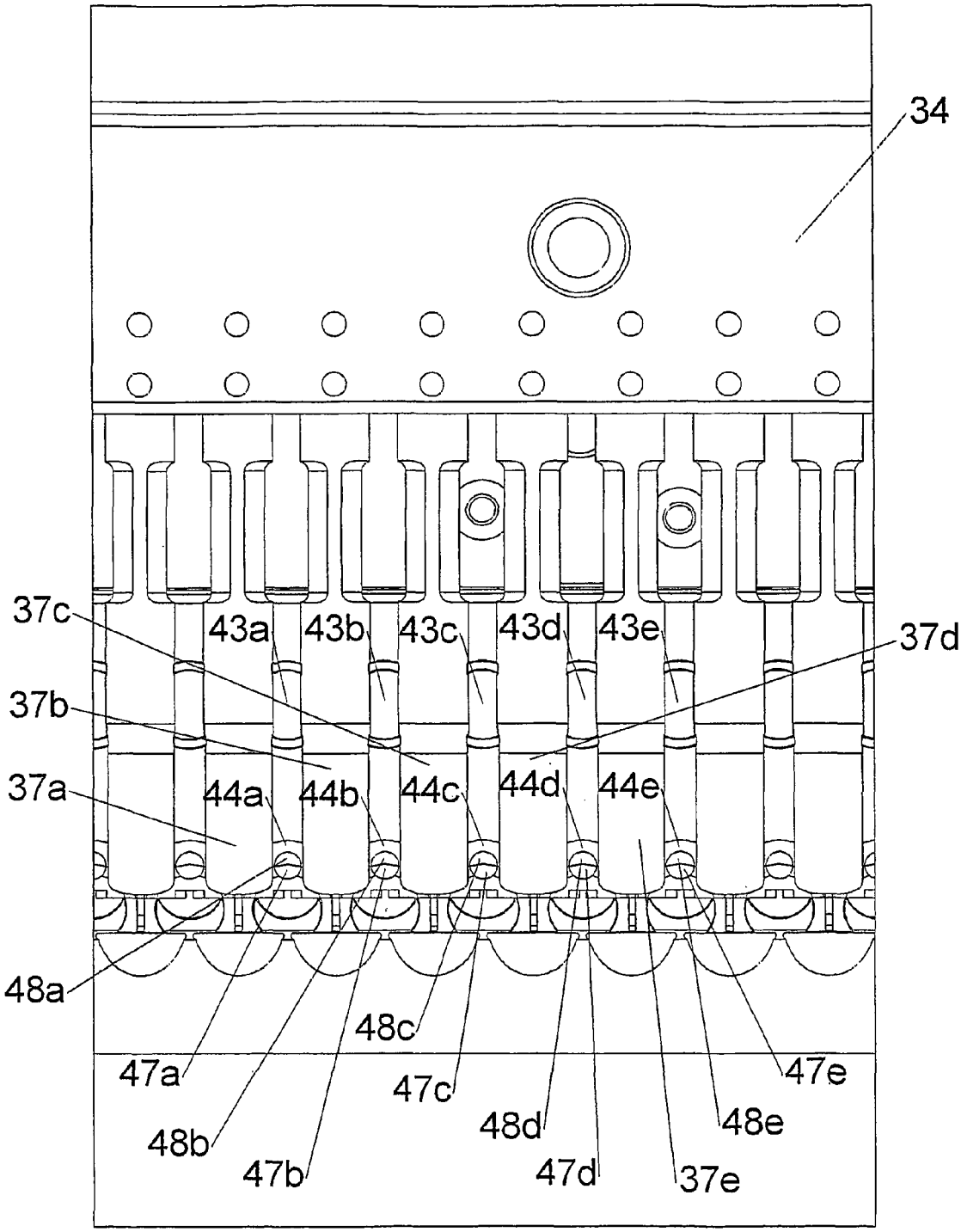
FIG. 9 shows a front view of a portion of the working face shown in figure is 7 and 8 with the fingers raised.

Referring now to FIGS. 7 to 11 a portion of the working faces of mould sections 30 and 31 are shown. These working faces may extend to the left and to the right as required to form a desired width of mesh. A plurality of fingers, of which only 37*a* to 37*d* are indicated, are secured to bar 34. Bar 34 is connected to arm 35 and raises and lowers fingers 37*a* to 37*d* as roller 35 moves in track 36. FIG. 9 shows fingers 37*a* to 37*d* in their raised position whilst FIGS. 7 and 8 show fingers 37*a* to 37*d* in their lowered position.

Figure 12:
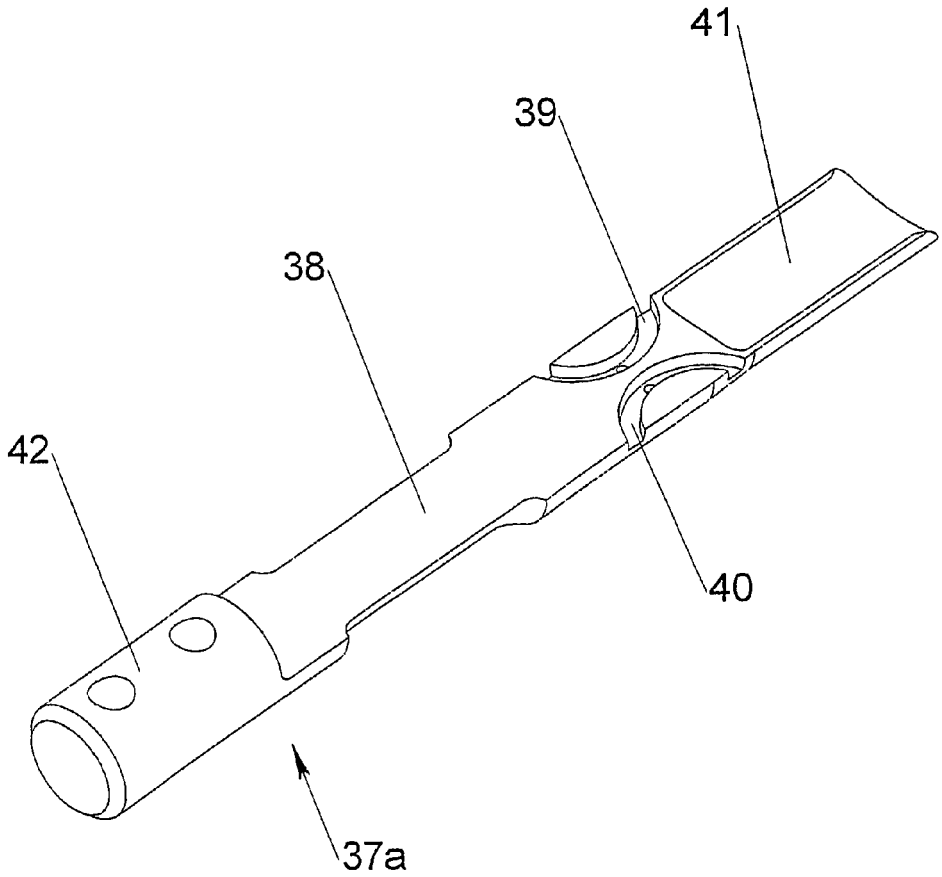
FIG. 12 shows a perspective back view of a finger.
Figure 13:
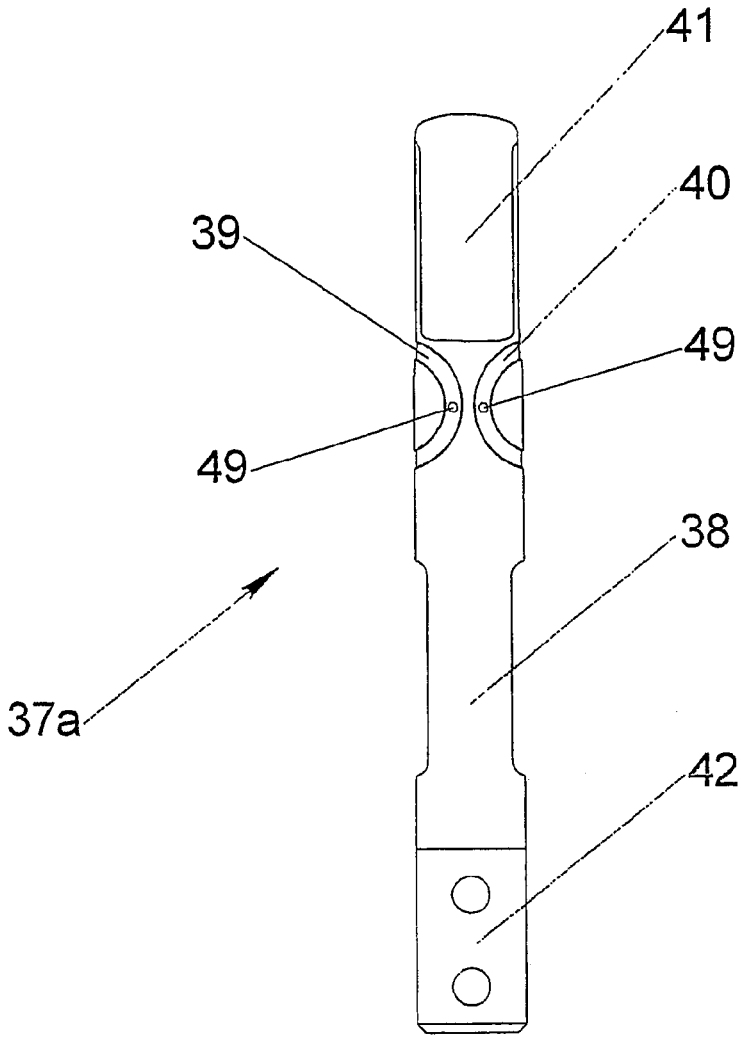
FIG. 13 shows a back view of a finger.
Figure 14:
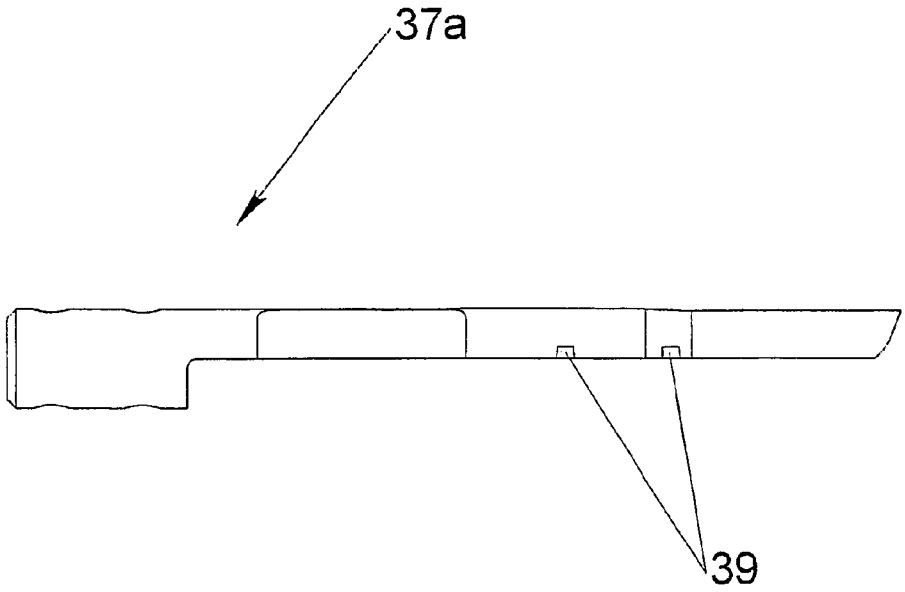
FIG. 14 shows a side view of a finger.
Figure 15:
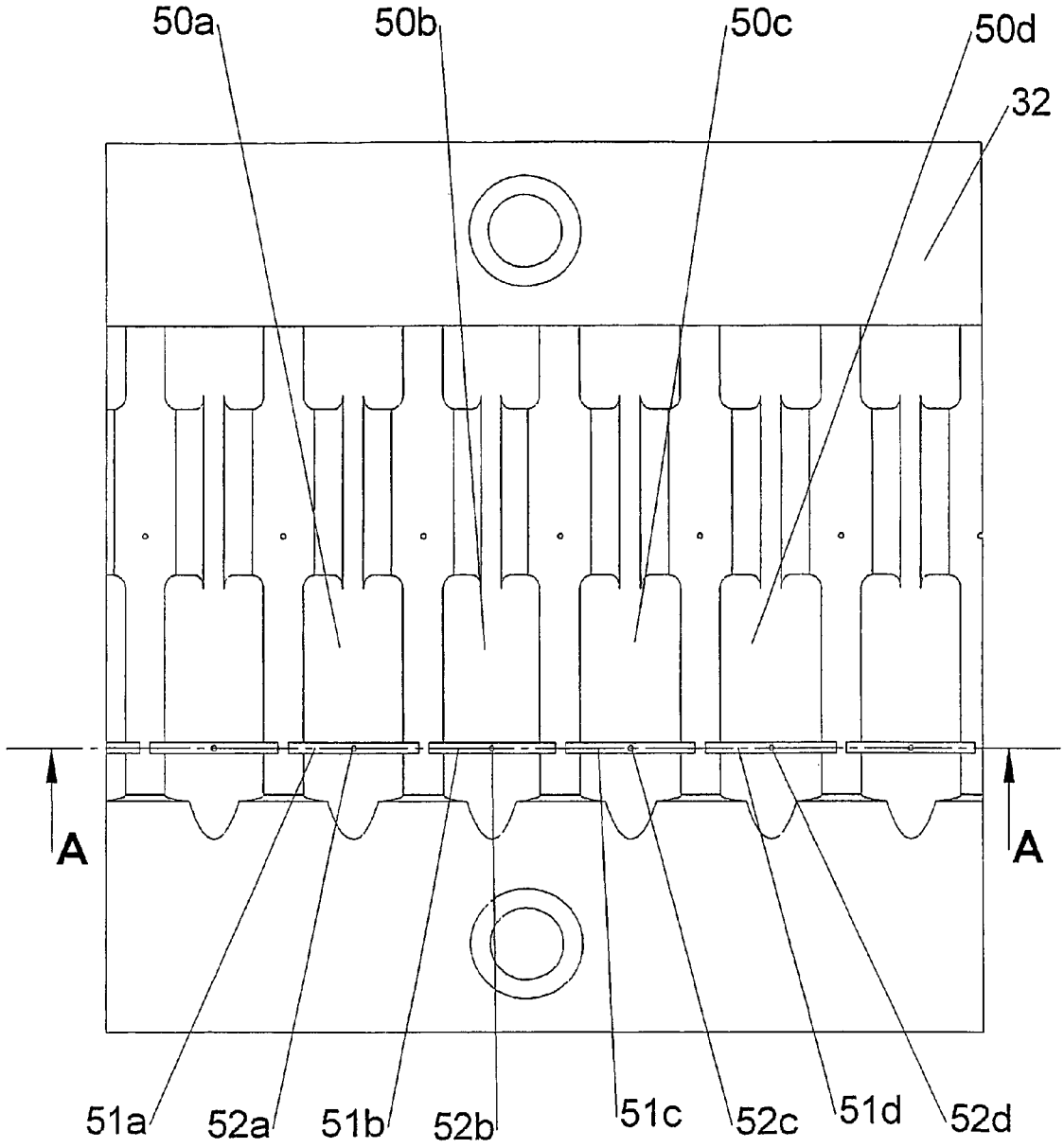
FIG. 15 shows a front view of the working face of the mould section opposite to the working face shown in FIGS. 7 to 10.
Figure 16:
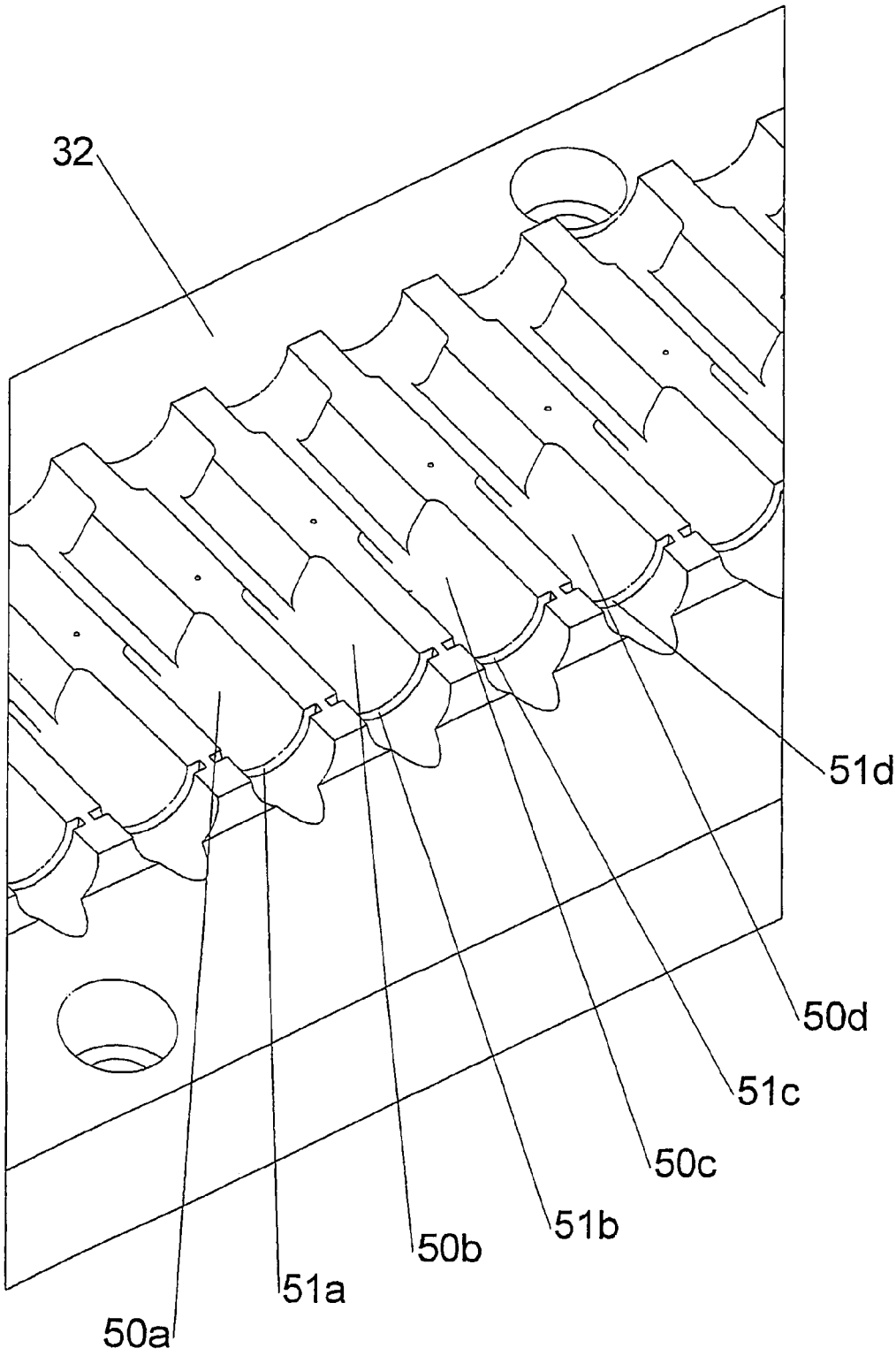
FIG. 16 shows a perspective view of the working face of the mould section shown in FIG. 15.
Figure 17:
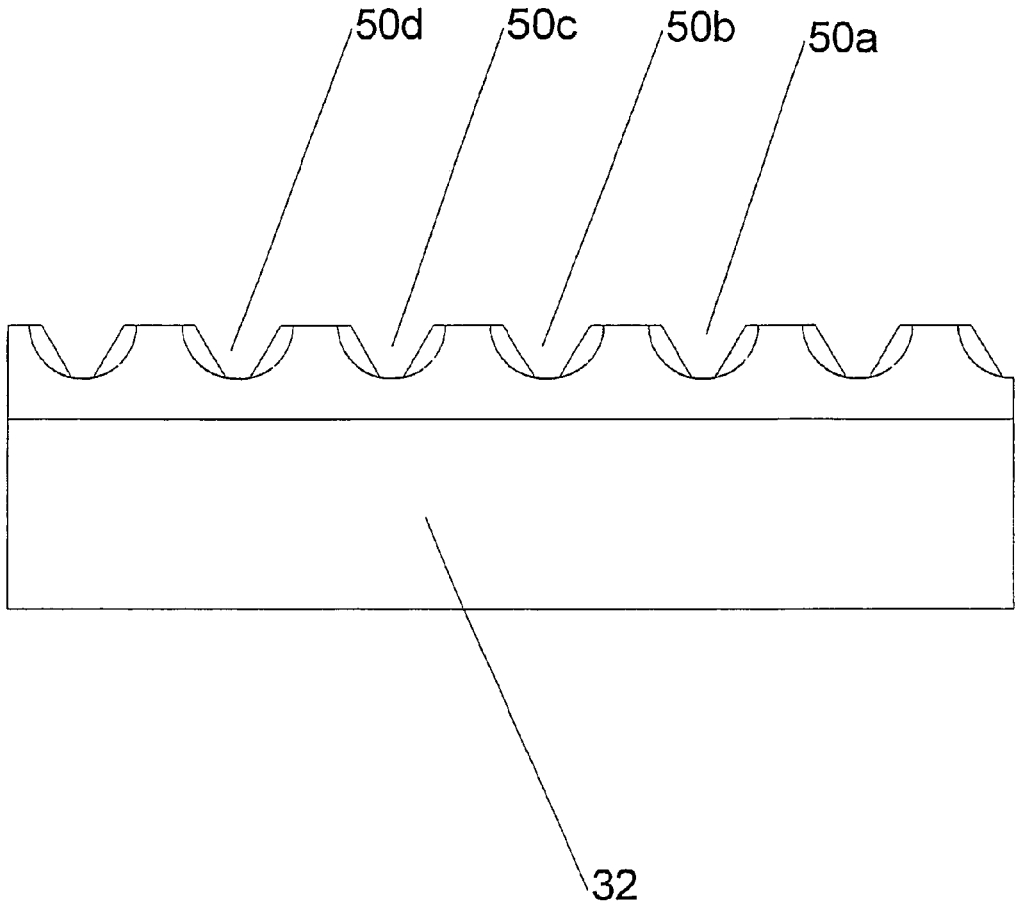
FIG. 17 shows a top view of the mould section shown in figures of 15 and 16.
Figure 18:
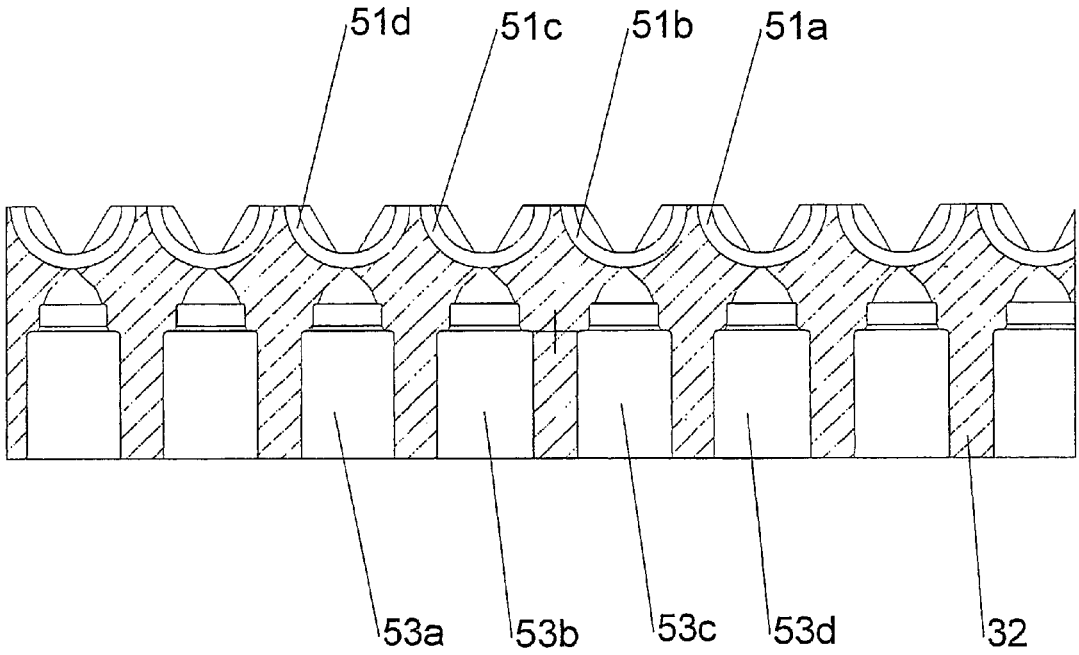
FIG. 18 shows a cross-sectional view through the mould section shown in FIG. 16 along line A-A.
Figure 19A:
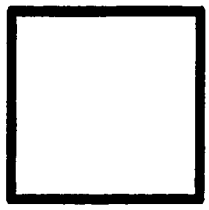
FIGS. 19A to H show a variety of possible link element shapes.
Figure 19B:
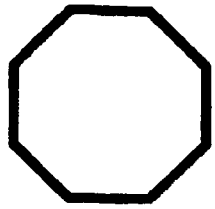
Figure 19C:
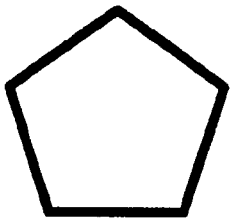
Figure 19D:
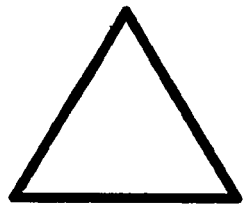
Figure 19E:
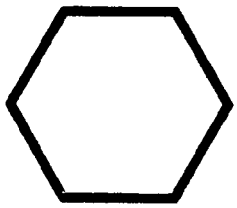
Figure 19F:
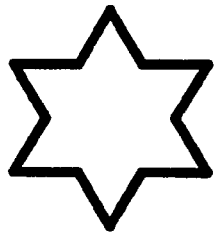
Figure 19G:
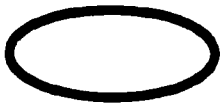
Figure 19H:
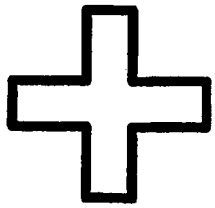

Preformed rings are supplied to the apparatus through supply tubes, some of which are indicated at 43*a* to 43*e*. Referring to FIGS. 12 to 14 the form of the fingers 37*a* to 37*d* is shown. Finger 37*a* has partial annular cavities 39 and 40 in rear face 38. These cavities 39 and 40 are positioned so that when the fingers 37*a* to 37*d* are in the raised position shown in FIG. 9 rings supplied from supply tubes 43*a* to 43*e* may be located within partial annular cavities 39 and 40 of adjacent fingers. Cavities 39 and 40 include biasing elements 49 which urge rings retained therein away from cavities 39 and 40. The end 42 of finger 37*a* is engaged with bar 34. The distal end 41 is scalloped to assist product exit from the mould.

Figure 10:
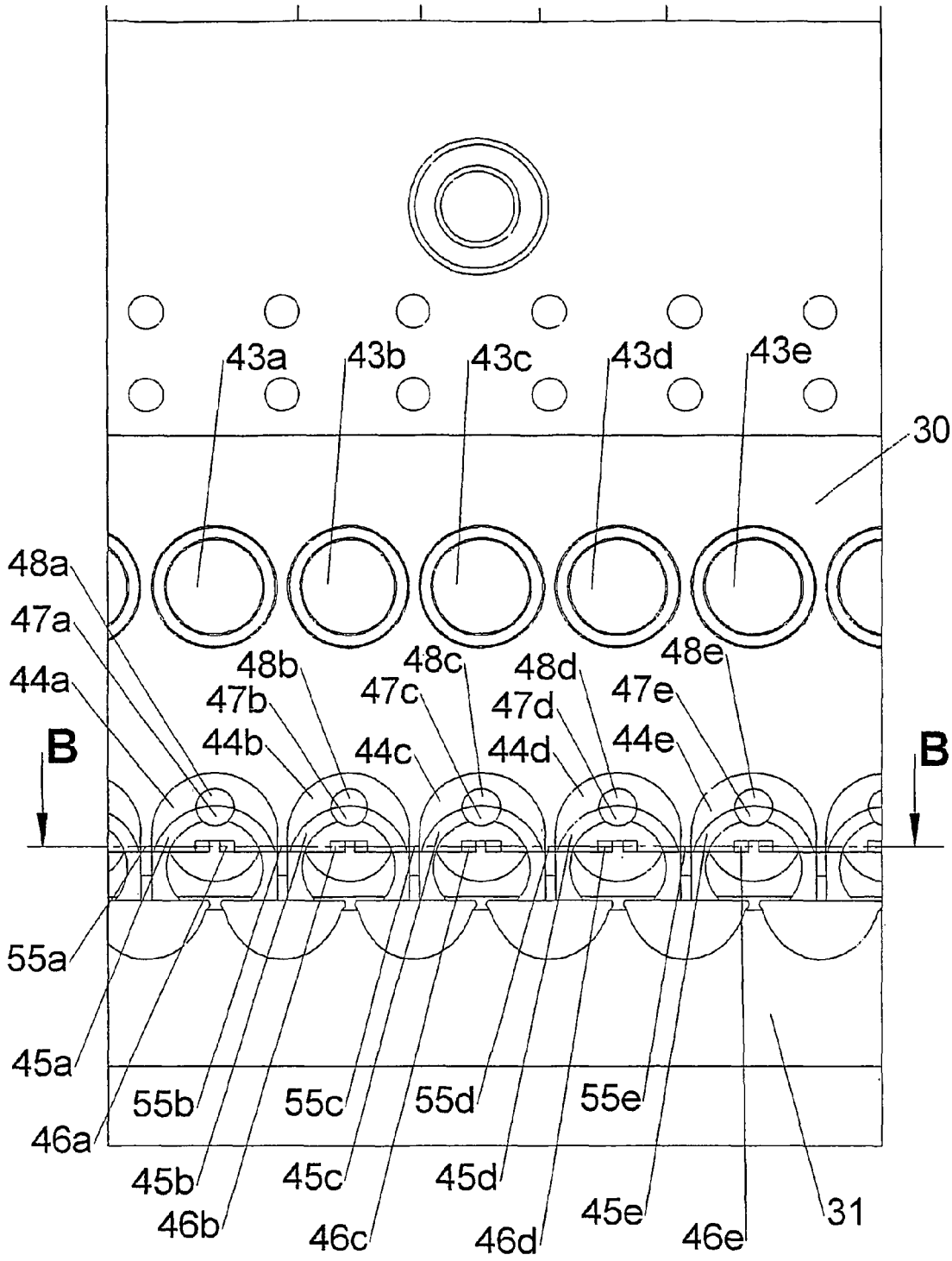
FIG. 10 shows a front view of a portion of the working face shown in FIGS. 7 to 9 without the fingers.

Referring now to FIGS. 9 and 10 the working faces of mould sections 30 and 31 include cavities 45*a* to 45*e* for accommodating preformed rings and cavities 44*a* to 44*e* for accommodating rings overlapping those in cavities 45*a* to 45*e*. Ejector pins 48*a* to 48*e* move in and out in a direction normal to the page to assist in ejecting rings as will be described later. Ejector pins 48*a* to 48*e* include undercut sections 47*a* to 47*e* which accommodate rings within cavities 45*a* to 45*e* when retracted.

Figure 11:
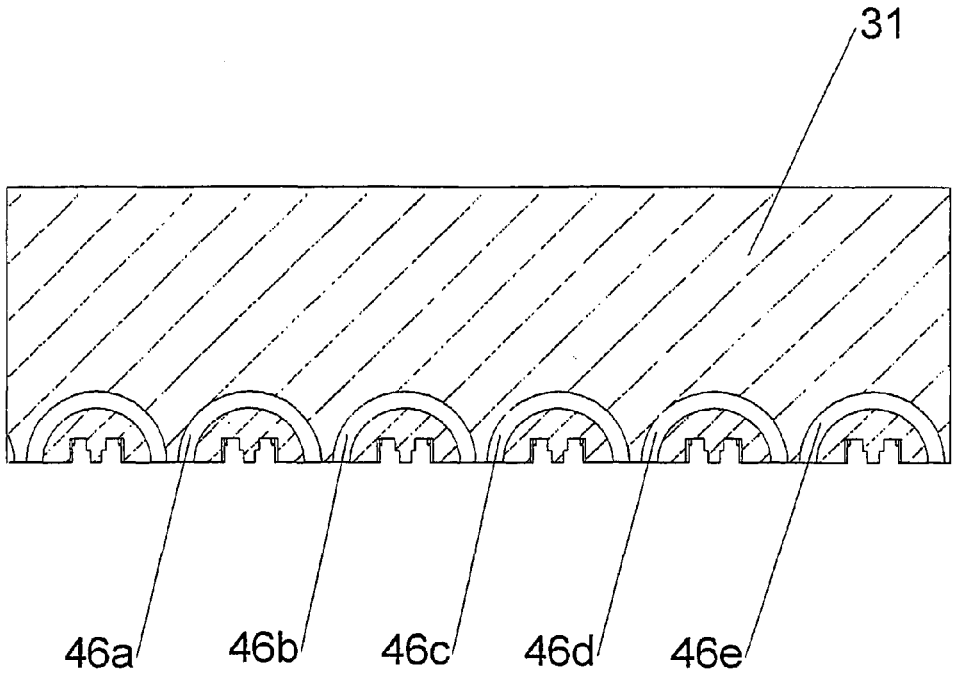
FIG. 11 shows a sectional view along line B-B in FIG. 10.

Referring now to FIG. 11 a view along the line B-B is shown (see FIG. 10). It can be seen that semicircular cavities 46*a* to 46*e* are provided normal to the working face of mould section 31. Semicircular protrusions 55*a* to 55*e* which define half the circular core of a ring extend from mould section 30 so that when the mould is closed half an annular ring is defined by cavities 46*a* to 46*e* and protrusions 55*a* to 55*e*.

Referring to FIGS. 15 to 18 the working face of mould section 32 shown. A plurality of semicircular recesses 51*a* to 51*d* form the other half of the annular cavities which form the moulded rings. Fingers 37*a* to 37*d* locate within cavities 50*a* to 50*d* with fingers 37*a* to 37*d* defining half of the core of rings formed in the annular cavities (the other half being formed by protrusions 55*a* to 55*e*). Injectors 53*a* to 53*d* (see FIG. 18) inject molten material into semicircular cavities 51*a* to 51*d* through apertures 52*a* to 52*d* during moulding. In one embodiment, the material is thermoplastic. In another embodiment, the material is metal.

Operation of the apparatus will now be described with reference to FIGS. 6*a* to 18. Initially mould sections 30 and 31 are separated from mould section 32 and the fingers are in the raised position shown in FIGS. 6*c* and 9. Rings contained in supply tubes 43*a* to 43*e* are urged towards fingers 37*a* to 37*d* and are retained within recesses 39 and 40 of respective fingers. Bar 34 is then moved down as mould sections 30 and 31 are moved towards mould section 32, so that the fingers assume the positions shown in FIG. 8. Biasing elements 49 in recesses 39 and 40 urge the rings into recesses 44*a* to 44*e*. These rings overlap rings already positioned within recesses 45*a* to 45*e*.

Mould sections 30 and 31 are then closed against mould section 32 so that fingers 37*a* to 37*d* are accommodated within recesses 50*a* to 50*d* (see FIG. 6*a*). Mould section 30 is also urged back into mould section 31 as the mould is closed. When the mould is closed recesses 51*a* to 51*d* and 46*a* to 46*d* define a disc shaped cavity. Fingers 37*a* to 37*d* in conjunction with projections 55*a* to 55*e* define a circular core so that a series of annular cavities are defined.

In one embodiment plastics is then injected by injectors 53*a* to 53*d* into cavities 51*a* to 51*d* so that rings are formed in cavities 51*a* to 51*d* and 46*a* to 46*d*. Alternatively, cavities 51*a* to 51*d* (or another part of the mould cavity for each ring) may be commonly fed with molten material. Mould section 31 is then moved away from mould section 32 (as shown in FIG. 6*b*) and simultaneously mould section 30, which is biased with respect to mould section 31, moves away from mould section 31 sufficiently to enable rings formed in the mould to be released from mould section 30. Mould sections 30 and 31 are then moved further away, as indicated in FIG. 6*c*, along with fingers 37*a* to 37*d*. As mould sections 30 and 31 are moved away from mould section 32 roller 35 reaches a section in slot 36 where it causes bar 34 to rise. Bar 34 eventually rises to the position shown in FIGS. 6*c* and 9.

At this point ejector pins 48*a* to 48*e* move in a direction out of the page to eject rings retained within cavities 45*a* to 45*e*. However, the rings in recesses 44*a* to 44*e* are retained as they are located on top of ejector pins 48*a* to 48*e* and behind fingers 37*a* to 37*e*. Fingers 37*a* to 37*e* are then partially lowered as mould section 30 is moved towards mould section 32 to retain the rings in recesses 44*a* to 44*e*. Ejector pins 48*a* to 48*e* are then retracted and the rings retained in recesses 44*a* to 44*e* then drop into recesses 45*a* to 45*e*. Mould sections 30 and 31 then close with mould section 32 and the apparatus is ready for the next mould cycle.

Although the link elements are shown to be formed in rows it will be appreciated that other moulding arrangements may be employed. For example adjacent link elements may be offset with respect to one another. It will also be appreciated that the apparatus may be adapted to enable two sheets of mesh to be joined. It will be appreciated that the method of invention may be implemented in many ways.

Following production the mesh may undergo further treatment processes. In the process of "flash flaming" the mesh may be exposed to a high-temperature heat source for a short period of time so that any minor surface imperfections are melted and each link element has a substantially smooth surface. Further, a coating may be applied to the mesh by electroplating, spray painting or some other coating process. Coatings may be applied to provide physical properties or a particular appearance.

Mesh formed by the method of invention may be further processed to form products. A mesh may be maintained in a desired configuration, for example by draping the mesh over a mould, and then heating it so that the link elements fuse together and then cooling it so that the linking elements remain fixed relative to one another forming a rigid structure.

Alternatively, the mesh may be maintained in a desired configuration and a settable composition, such as a resin, is then applied and configuration is maintained until the settable material sets to form a rigid structure.

Link elements may be formed of a variety of materials that can exist in a fluid phase and then set, such as plastics, metals, glass, absorbent or non absorbent foams, flexible polymers etc. A mesh may contain a mixture of linking elements formed of different materials. Further, the optical characteristics of link elements may be varied over the mesh to create a pattern or particular visual appearance. For example, different patterns may be created using link elements of different colours and/or transparent link elements.

Link elements may also take a variety of shapes which may be mixed with a mesh. Some examples of closed loop link elements are shown in FIGS. 19A to 19H. Other novelty shapes such as hearts etc may also be used. Further, link elements may have patterns or indicia moulded into their surface.

Figure 20:
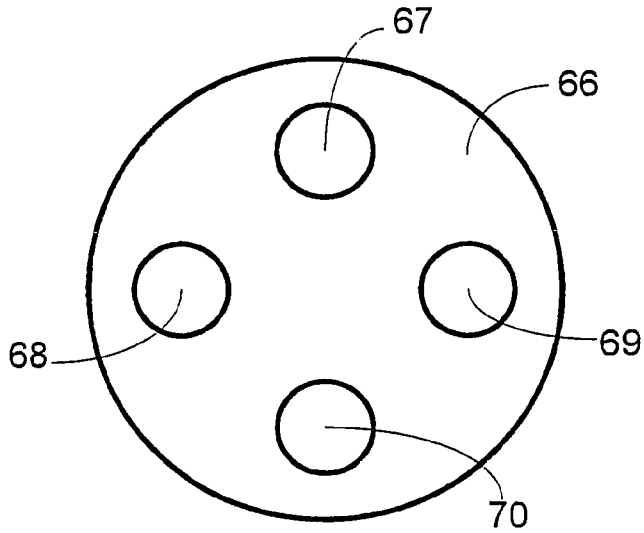
FIG. 20 show a further possible link element shape.

FIG. 20 shows another form of link element in the form of a circular disc 66 having a plurality of apertures 67 to 70 provided therethrough. Rings or other linking elements may be formed through apertures 67 to 70. It will be appreciated that a wide variety of link element shapes and configurations may be employed as well as traditional mesh arrangements utilising 1:3; 1:4 or 1:6 link element layouts.

Mesh formed by the method or apparatus of invention may find use in a wide variety of applications including: filtration; pollution control; signage, flags, displays etc.; conveyors; baffles; armour; clothing ; furniture, such as hammocks, deck chairs etc; screens, curtains etc.

It has been found that mesh is particularly effective at collecting materials such as oil from the surface of a fluid, such as water. A mesh formed of link elements formed of absorbent material or including links formed of an absorbent material in may provide additional capacity for oil collection. The mesh may be provided on a drum or as part of a conveyor system so that collected material may be continuously removed by a washing system or wringer etc.

There is thus provided a quick and economic method and apparatus for the continuous manufacture of mesh using a variety of materials. Mesh having a range of physical and optical properties may be produced. The mesh may have good structural strength and a smooth surface appearance. The method may also allow mesh having small link elements to be produced economically.

While the present invention has been illustrated by the description of the embodiments thereof, and while the embodiments have been described in detail, it is not the intention of the Applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departure from the spirit or scope of the Applicant's general inventive concept.

The invention claimed is:

1. A method of forming a mesh comprising:

advancing a first plurality of formed link elements from a first set of positions to a second set of positions within a mold, the first set of positions different from the second set of positions; and for each successive advancement of the first plurality of formed link elements, positioning a second set of formed link elements in the first set of positions and molding a plurality of new link elements in the mold through and separate from the first and second pluralities of formed link elements that are positioned in the first set of positions and the second set of positions so as to interconnect the plurality of formed link elements that are positioned in the first and second set of positions with the new link elements to form a continuous mesh of interconnected link elements.

2. A method as claimed in claim 1, wherein the first and second plurality of formed link elements are respectively positioned in a row.

3. A method as claimed in claim 2 wherein, apart from at the edges of the continuous mesh, the plurality of new molded link elements link on each side to a previously provided formed link element and to a formed link element of a new row provided.

4. A method as claimed in claim 1 wherein the plurality of new link elements are molded in an orientation transverse to the first and second plurality of formed link elements.

5. A method as claimed in claim 4 wherein each one of the plurality of new link elements are molded substantially normal to the respective first and second plurality of formed link elements.

6. A method as claimed in claim 1 wherein the first and second plurality of formed link elements and the plurality of new link elements are in the form of a closed loop having a central aperture.

7. A method as claimed in claim 1 wherein the first and second plurality of formed link elements and the plurality of new link elements are rings.

8. A method as claimed in claim 1 wherein the first and second plurality of formed link elements have multiple apertures for receiving the plurality of new link elements molded therethrough.

9. A method as claimed in claim 1 wherein the first and second plurality of formed link elements are positioned to have common apertures in which the new link elements are molded therethrough.

10. The method of claim 1, wherein each one of the first plurality of formed link elements is interconnected to at least two new molded link elements from the plurality of new link elements.

11. A method as claimed in claim 1 wherein the first and second plurality of formed link elements and the plurality of new link elements are formed of plastics.

12. A method as claimed in claim 1 wherein the first and second plurality of formed link elements and the plurality of new link elements are formed of glass.

13. A method as claimed in claim 1 wherein the first and second plurality of formed link elements and the plurality of new link elements are formed of metal.

14. A method as claimed in claim 1 wherein at least some link elements in the first and second plurality of formed link elements and the plurality of new link elements have different optical characteristics.

15. A method as claimed in claim 14 wherein at least some link elements in the first and second plurality of formed link elements and the plurality of new link elements have different colors which form a pattern in the mesh.

16. A method as claimed in any claim 1, further comprising flash flaming the interconnected link elements after formation of the mesh.

17. A method as claimed in claim 1, further comprising:

maintaining the interconnected link elements after formation of the mesh in configuration;

fusing the interconnected link elements together by applying heat; and cooling the interconnected link elements in a manner to retain the configuration.

18. A method as claimed in claim 1, further comprising electroplating the interconnected link elements after formation of the mesh.

19. A method as claimed in claim 1, further comprising applying a binding agent to the interconnected link elements of the formed mesh to form a rigid composite product.

20. The method of claim 19, wherein the binding agent is a resin.

21. A method comprising:

a. positioning a first plurality of preformed link elements in a first plurality of first positions in a mold;

b. positioning a second plurality of preformed link elements in a second plurality of second positions in the mold, the second positions different from the first positions and the second plurality of preformed link elements positioned to form overlapping regions with respect to the first plurality of preformed link elements;

c. molding a third plurality of link elements through the overlapping regions in a third plurality of positions in the mold to interlink with the first plurality and the second plurality of link elements subsequent to the positioning of the first and second pluralities of link elements;

d. advancing a subset of the first plurality of link elements to reside in the second plurality of second positions in the mold; and e. molding a fourth plurality of link elements to interlink with the subset of the first plurality of link elements.

22. The method of claim 21, wherein the third plurality of link elements are molded in an orientation transverse to the first and second plurality of preformed link elements.

23. The method of claim 22, wherein each one of the third plurality of link elements are molded substantially normal to respective first and second plurality of formed link elements.

24. The method of claim 21, wherein the first and second plurality of preformed link elements and the third plurality of link elements are in the form of a closed loop having a central aperture.

25. The method of claim 21, wherein the first and second plurality of preformed link elements are rings and the third plurality of link elements are molded as rings.

26. The method of claim 21, wherein the first and second plurality of preformed link elements include multiple apertures where the third plurality of link elements are molded therethrough.

27. The method of claim 21, wherein each one of the first plurality of preformed link elements is interconnected to at least two link elements from the third plurality of new link elements on either side.

28. The method of claim 21, wherein the first and second plurality of preformed link elements are formed of plastics and the third plurality of link elements are molded of plastic.

29. The method of claim 21, wherein the first and second plurality of preformed link elements are formed of glass and the third plurality of link elements are molded of glass.

30. The method of claim 21, wherein the first and second plurality of preformed link elements are formed of metal and the third plurality of link elements are molded of metal.

31. The method of claim 21, wherein at least some of the preformed link elements of the first and second plurality of preformed link elements have different optical characteristics and the third plurality of link elements are molded to have different optical characteristics.

32. The method of claim 31, wherein at least some of the first and second plurality of preformed link elements and the third plurality of link elements have different colors.

33. The method of claim 21, further comprising flash flaming a completed mesh.

34. The method of claim 21, further comprising:

maintaining interconnected link elements after formation of a mesh, in a predetermined configuration;

applying heat to fuse the interconnected link elements together; and cooling the interconnected link elements in a manner to retain the predetermined configuration.

35. A method for forming a continuous mesh of interconnected link elements, the method comprising:

advancing at least two formed link elements from a first group of positions to a second group of positions in a mold, the second group of positions separate from the first group of positions;

disposing at least two additional formed link elements into the first group of positions after advancing the at least two formed link elements; and molding a new link element in a mold through and separate from the at least two formed link elements and the at least two additional formed link elements to form an interconnected set of link elements.

* * * * *